US006344003B1

(12) United States Patent
Choung

(10) Patent No.: US 6,344,003 B1
(45) Date of Patent: Feb. 5, 2002

(54) GOLF TEE

(76) Inventor: Robert Sang-Bong Choung, 1000 MacArthur St., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/510,881

(22) Filed: Feb. 23, 2000

(51) Int. Cl.[7] ..... A63B 53/00
(52) U.S. Cl. ..... 473/387; 473/392
(58) Field of Search ..... 473/387–403; D21/717–718

(56) References Cited

U.S. PATENT DOCUMENTS 1,551,207 A * 8/1925 Nial et al. ..... 473/401
1,644,980 A * 10/1927 Clausing ..... 473/402
1,678,944 A * 7/1928 Jacobsen ..... 473/401
2,508,155 A * 5/1950 Gerlach ..... 473/403
D210,837 S * 4/1968 Warner ..... 473/402
D246,803 S * 12/1977 Steinberg ..... D21/718
4,367,879 A * 1/1983 Messer ..... 473/402
4,783,077 A * 11/1988 Lemon ..... 473/402
5,193,803 A * 3/1993 Flick, III ..... 473/392
6,053,822 A * 4/2000 Kolodney et al. ..... 473/401

* cited by examiner

*Primary Examiner*—Steven Wong
(74) *Attorney, Agent, or Firm*—Lee & Hong

(57) ABSTRACT

A golf tee for use with a golf ball comprises a body having a tapered shape for placing into ground; and a support member extending from an upper portion of the body. The support member supports the golf ball at a plurality of regions which are offset from a longitudinal axis of the golf ball so that the golf ball is spatially separated from the top portion of the body. The support member includes a pair of legs extending from the body of the golf tee, legs extending opposite to each other to support the golf ball at a plurality of regions which are offset from a longitudinal axis of the golf ball. In particular, the pair of legs has a substantially U-shaped contour to partially extend underside of the golf ball. The support member further includes a pair of receptacles, each receptacle coupled to an end of corresponding legs. Preferably, the receptacle is elliptically shaped to increase a lateral support of the golf ball.

5 Claims, 2 Drawing Sheets

GOLF TEE

BACKGROUND OF THE INVENTION

1. Field of the Invention

The present invention relates generally to a golf tee, and more particularly, to a golf tee designed to improve accuracy of a golf ball trajectory.

2. Discussion of the Related Art

Golf is one of the most widely played sports activities in the United States. Not only is this activity already widespread, but the number of golfers continue to grow due to popularity of the sports caused by high stake games televised on televisions.

The sport of golf is typically played on a course consisting typically of eighteen holes. A set of clubs is used to strike a golf ball in each hole. Each hole has a tee box which defines a starting location of that hole in which a golfer places a golf ball and swings a golf club to strike the ball towards a designated green. Before striking the golf ball, the golfer first places a golf tee into the ground and then places a golf ball on the concave surface of the tee. Upon a proper impact of the golf ball with a club, the golf ball travels in a desired direction and trajectory.

In conventional golf tee, a golf ball is placed on the golf tee. The underside of the golf ball actually touches the concave surface of the golf tee. As a result, the golf club head makes impact with the golf ball as well as the golf tee, thus causing a slight misplacement of the golf ball with respect to the club head. Such misplacement causes a golf ball to deviate from its intended trajectory.

SUMMARY OF THE INVENTION

Accordingly, the present invention is directed to a golf tee that substantially obviates one or more of the problems due to limitations and disadvantages of the related art.

It is an object of the present invention to provide a golf tee to allow greater surface contact with a golf club for improved accuracy.

It is another object of the present invention to provide a golf tee that increases back spin of the golf ball.

It is also an object of the present invention to provide a golf tee that is easy to manufacture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a golf tee for use with a golf ball comprises a body having a tapered shape for placing into ground; and a support member extending from an upper portion of the body. The support member supports the golf ball at a plurality of regions which are offset from a longitudinal axis of the golf ball so that the golf ball is spatially separated from the top portion of the body. Preferably, a top portion of the body has an elliptical cross-section.

According to one aspect of the present invention, the support member includes a plurality of legs extending from the body of the golf tee to support the golf ball at a plurality of regions which are offset from a longitudinal axis of the golf ball. More specifically, the support member includes a pair of legs extending from the body of the golf tee, legs extending opposite to each other to support the golf ball at a plurality of regions which are offset from a longitudinal axis of the golf ball. In particular, the pair of legs has a substantially U-shaped contour to partially extend along the underside of the golf ball without actually touching the golf ball.

According to another aspect of the present invention, the support member further includes a pair of receptacles, each receptacle coupled to an end of corresponding legs. Preferably, the receptacle is elliptically shaped to increase a lateral support of the golf ball.

According to another aspect of the present invention, a top portion of the body has a recessed member. Alternatively, the top portion of the body may have a convex member.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

With reference to the drawings, and in particular to FIGS. 1–8 thereof, a golf tee embodying the principles and concepts of the present invention will be described.

Figure 1:
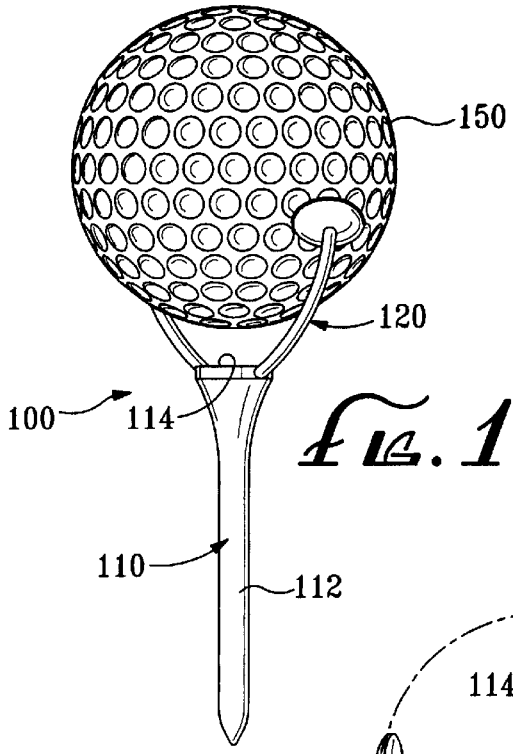
FIG. 1 illustrates a perspective view of a golf tee with a golf ball placed thereon according to a first embodiment of the present invention.
Figure 2:
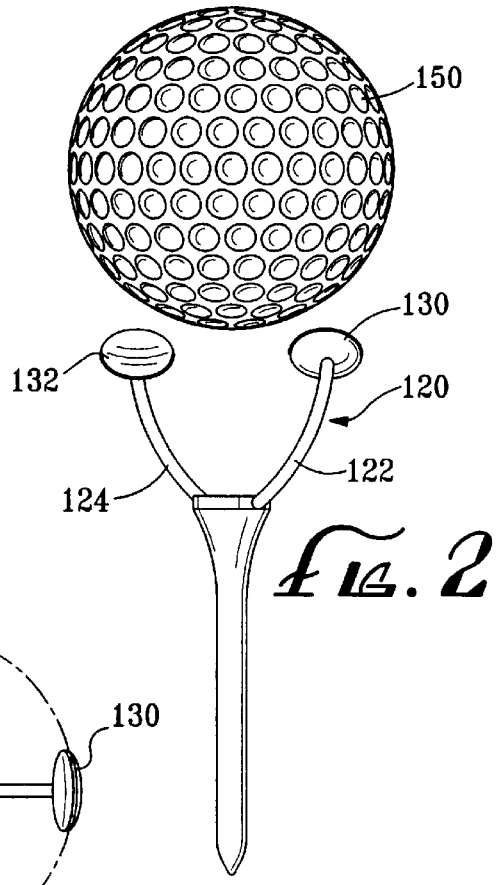
FIG. 2 illustrates a perspective view of the golf tee of FIG. 1 with the golf ball displaced from the golf tee.

FIG. 1 illustrates a perspective view of a golf tee 100 with a golf ball 150 placed thereon according to a first embodiment of the present invention. FIG. 2 illustrates a perspective view of the golf tee of FIG. 1 with the golf ball displaced from the golf tee. According to the first embodiment, the golf tee 100 includes an elongated body 110 and a U-shaped support member 120 extending from the top of the body 110. The body 110 has a tapered shape to allow easy insertion into the ground. Preferably, the golf tee 100 is molded with plastic, steel or other suitable materials known to one of ordinary skill in the art. For example, the golf tee 100 may be also formed with wood.

The body 110 is generally in a form of a common golf tee having an elongated shaft 112 and a recessed member 114 formed on the top of the shaft 112 for receiving a golf ball thereon. Although the upper portion of the shaft 112 is wider than the lower portion in FIG. 1, the body 110 may be formed of an elongated shaft member having substantially identically cross-section.

Figure 5:
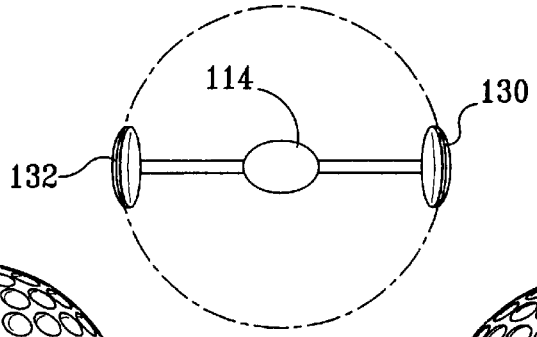
FIG. 5 illustrates a top plan view of the golf tee of FIG. 1.
Figure 3:
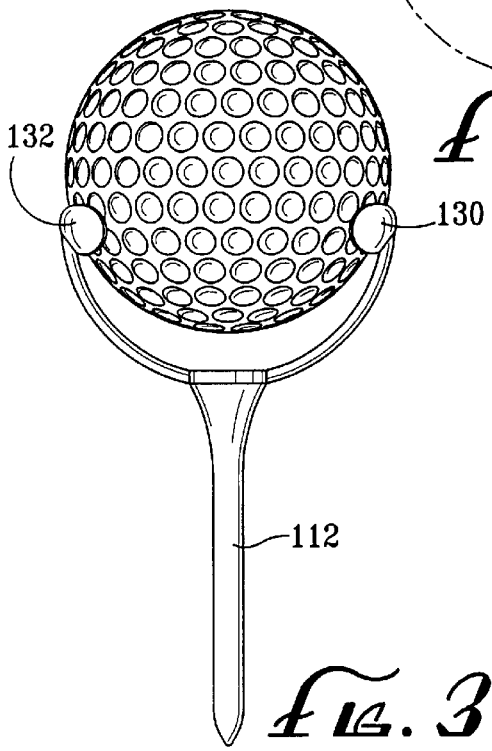
FIG. 3 illustrates a front elevation view of the golf tee of FIG. 1.
Figure 4:
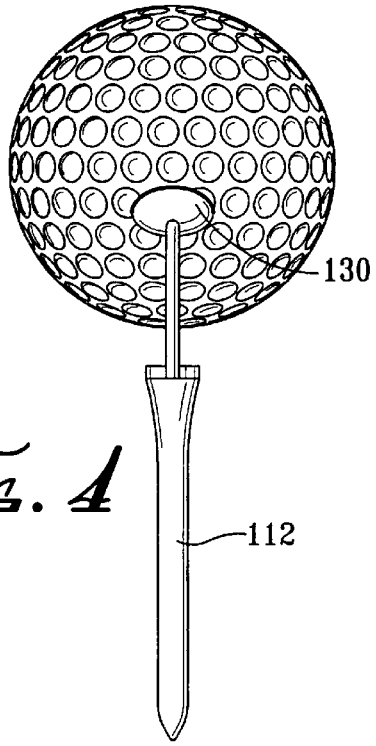
FIG. 4 illustrates a side elevation view of the golf tee of FIG. 1.

Referring to FIGS. 3 to 5, the recessed member 114 of the body 110 according to the golf tee 100 preferably has an elliptical surface for making contact with the golf ball 150 when the golf ball 150 is initially placed on the golf tee 100. Alternatively, other surface shapes are also suitable for the present invention.

The support member 120 extends from two opposite ends of the elliptically recessed member 114. Preferably, the support member 120 extends from the longer ends of the recessed member 114. The support member 120 includes a pair of legs 122, 124 and corresponding receptacles 130 and 132. The legs 122 and 124 have a contour similar to the shape of the golf ball 150. As a result, when the golf ball 150 is placed on the golf tee 100, the legs 122 and 124 partially extend along the underside of the golf ball 150 without actually touching it. Preferably, the support member 120 may be made of plastic, steel, aluminum or other suitable materials known to one of ordinary skill in the art to provide flexibility to the legs 122 and 124.

In the preferred embodiments, the legs 122 and 124 are resilient but flexible so that when the golf ball 150 is initially placed on the golf tee 100, the downward pressure imposed by a golfer who is placing the golf ball 150 on the golf tee 100 pushes the legs 122 and 124 slightly outward to allow the golf ball 150 to make contact with the recessed member 114 of the body 110 to push the golf tee 100 into the ground. Once the downward pressure is removed, the legs 122 and 124 keeps their original shape, thereby causing the golf ball 150 to be supported only by the receptacles 130 and 132. As a result, a small gap is formed between the golf ball 150 and the top of the recessed member 114 of the golf tee 100.

Referring to FIGS. 3 and 5, attached to each end of the legs 122 and 124 is a receptacle 130, 132. The receptacle 130 also preferably has an elliptical and concave surface for supporting a golf ball 150 thereon. Two receptacles 130 and 132 are oppositely disposed at about the same height to stably support the golf ball from opposite ends. Preferably, the receptacles 130 and 132 are placed slightly below the horizontal center line of the golf ball 150. The concave surface of the receptacle 130, 132 are contoured to stably hug the outer circumference of the golf ball 150 without actually clamping the golf ball 150. The position and shape of the receptacles 130 and 132 with respect to the golf ball is best illustrated in FIG. 5. Although the first embodiment of the present invention illustrates two elliptical receptacles 130 and 132, other suitable shapes, such as circular and triangular receptacles, may be used without deviating from the gist of the invention.

Since the lower portion of the golf ball 150 is placed above the body 110 of the golf tee 100 without making contact, a head portion of a golf club makes a direct contact with the underside of the golf ball 150 without making contact with the top of the body 110. This results in, for example, improved back spin and accuracy of the golf ball 150.

Figure 6:
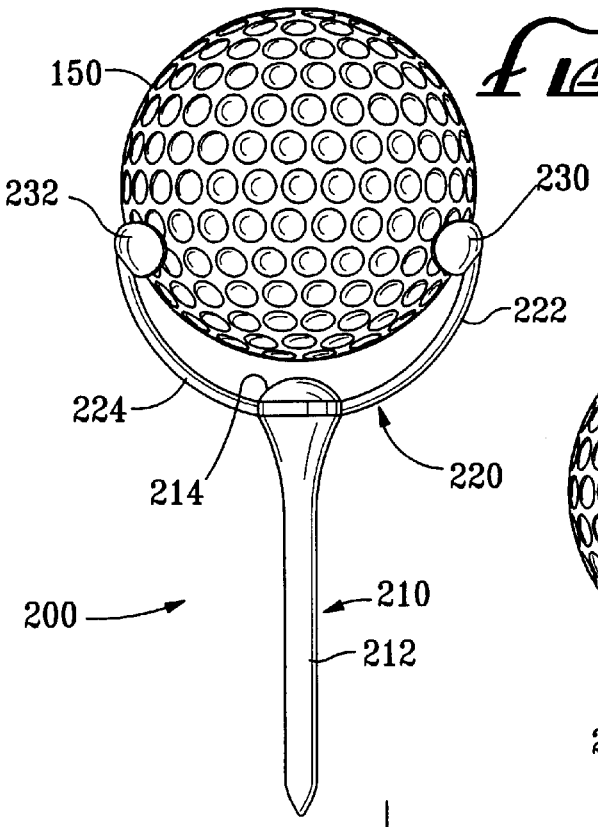
FIG. 6 illustrates a front elevation view of a golf tee according to a second embodiment of the present invention.
Figure 7:
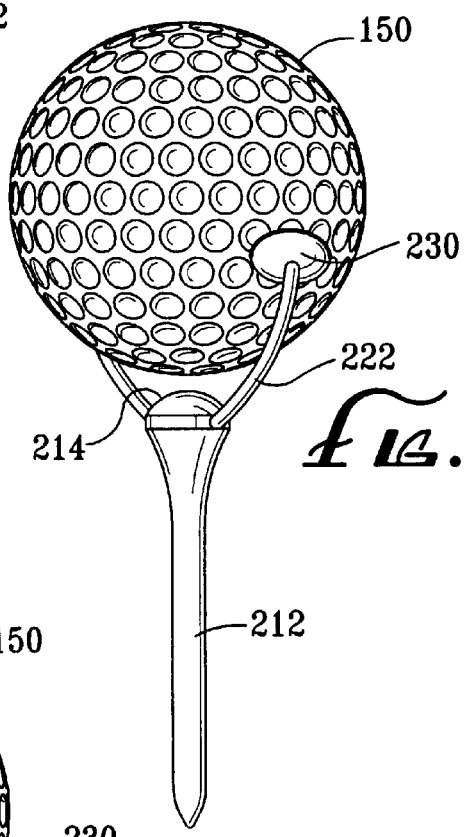
FIG. 7 illustrates a perspective view of the golf tee of FIG. 6.
Figure 8:
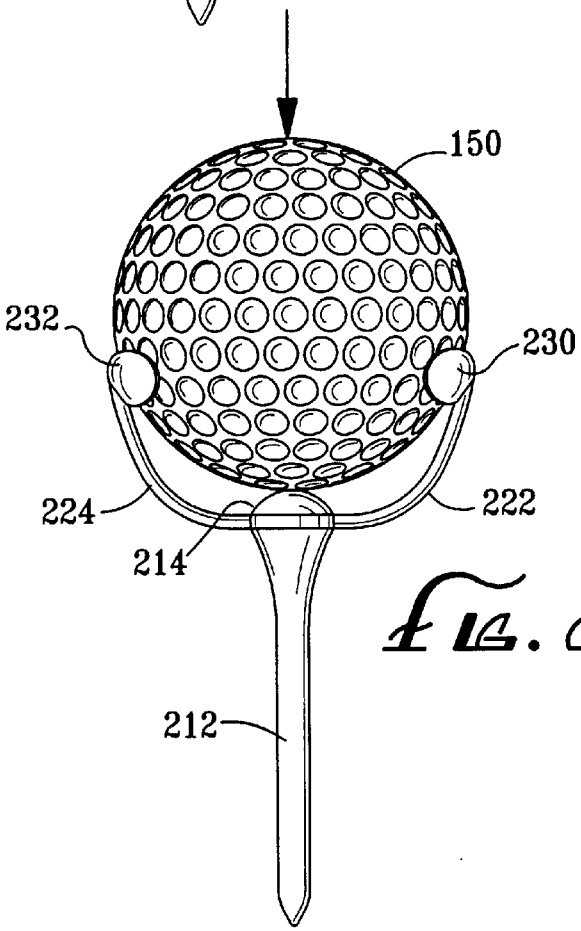
FIG. 8 illustrates a front elevation view of the golf tee with a golf ball.

FIG. 6 illustrates a front elevation view of a golf tee 200 according to a second embodiment of the present invention. FIG. 7 illustrates a perspective view of the golf tee 200 of FIG. 6. FIG. 8 illustrates a front elevation view of the golf tee 200 with a golf ball 150.

According to the second embodiment, the golf tee 200 includes an elongated body 210 and a U-shaped support member 220 extending from the top of the body 210. Preferably, the golf tee 200 is molded with plastic of other suitable materials known to one of ordinary skill in the art. For example, the golf tee 200 may be also formed with wood.

The body 210 is generally in a form of a common golf tee having an elongated shaft 212 and a convex member 214 formed on the top of the shaft 212 for making contact with a golf ball thereon.

Referring to FIGS. 6 to 8, the cross-section of the convex member 214 of the body 210 according to the golf tee 200 preferably has an elliptical shape similar to that of the first embodiment. Alternatively, other surface shapes are also suitable for the present invention.

The support member 220 upwardly extends from two opposite ends of the elliptical convex member 214. Preferably, the support member 220 extends from the longer ends of the convex member 214, similar to the golf tee shown in FIG. 5. The support member 220 includes a pair of legs 222, 224 and corresponding receptacles 230 and 232. The legs 222 and 224 have a contour similar to the shape of the golf ball 150. As a result, when the golf ball 150 is placed on the golf tee 200, the legs 222 and 224 partially extend along the underside of the golf ball 150 without actually touching it.

As shown in FIG. 8, the legs 222 and 224 are resilient but flexible so that when the golf ball 150 is initially placed on the golf tee 200, the downward pressure imposed by a golfer who is placing the golf ball 150 on the golf tee 200 pushes the legs 222 and 224 slightly outward to allow the golf ball 150 to make contact with the convex member 214 of the body 210 to push the golf tee 200 into the ground. Once the downward pressure is removed, the legs 222 and 224 keeps their original shape, thereby causing the golf ball 150 to be supported by the receptacles 230 and 232. As a result, a small gap is formed between the golf ball 150 and the top of the convex member 214 of the golf tee 200.

In FIGS. 6 to 8, attached to each end of the legs 222 and 224 is a receptacle 230, 232. The receptacle 230 also preferably has an elliptical and concave surface for supporting a golf ball 150 thereon. Two receptacles 230 and 232 are oppositely disposed at about the same height to stably support the golf ball from opposite ends. Preferably, the receptacles 230 and 232 are placed slightly below the horizontal center line of the golf ball 150. The concave surface of the receptacle 230, 232 are contoured to stably hug the outer circumference of the golf ball 150 without actually clamping the golf ball 150. The position and shape of the receptacles 230 and 232 with respect to the golf ball is identical to that of the golf tee 100 according to the first embodiment which is best illustrated in FIG. 5. Although the second embodiment of the present invention illustrates two elliptical receptacles 230 and 232, other suitable shapes, such as circular and triangular receptacles, may be used without deviating from the gist of the invention.

Similar to the first embodiment, because the lower portion of the golf ball 150 is placed above the body 210 of the golf tee 200 without making contact, a head portion of a golf club makes a direct contact with the underside of the golf ball 150 without making contact with the top of the body 210. This results in, for example, improved back spin and accuracy of the golf ball 150.

The first and second embodiments of the golf tee has a pair of legs extending vertically upward from the body. As an alternative embodiment, the legs may be extending upward at an angle, such as at about 45 to 75 degrees, to allow the golf ball to be placed offset from the longitudinal axis of the body of the golf tee. As a result, the golf club will first make an impact with the golf ball without first touching the body of the golf tee.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A golf tee for use with a golf ball, the golf tee comprising:

a body having a tapered shape for placing into ground; and a support member extending from an upper portion of the body, wherein the support member includes a least a pair of legs extending from the body of the golf tee to support the golf ball at a plurality of regions which are offset from a longitudinal axis of the golf ball, the pair of legs having a substantially U-shaped contour to partially extend underside of the golf ball, each leg having a receptacle connected thereto for supporting the golf ball, wherein the receptacles are positioned to allow at least a part of each receptacle to be viewed when addressing the golf ball and wherein the tee golf ball is supported only by the receptacles and does not actually touch the legs.

2. The golf tee of claim 1, wherein each receptacle is elliptically shaped to increase a lateral support of the golf ball.

3. The golf tee of claim 1, wherein a top portion of the body has a recessed member.

4. The golf tee of claim 1, wherein a top portion of the body has a convex member.

5. The golf tee of claim 1, wherein a top portion of the body has an elliptical cross-section.

* * * * *